US010519824B2

(12) United States Patent
Koguchi et al.

(10) Patent No.: US 10,519,824 B2
(45) Date of Patent: Dec. 31, 2019

(54) OIL SUPPLY DEVICE OF INTERNAL COMBUSTION ENGINE

(71) Applicant: MAZDA MOTOR CORPORATION, Hiroshima (JP)

(72) Inventors: Tomohiro Koguchi, Higashihiroshima (JP); Kenta Honda, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 141 days.

(21) Appl. No.: 15/757,028

(22) PCT Filed: Mar. 2, 2017

(86) PCT No.: PCT/JP2017/008225

§ 371 (c)(1),
(2) Date: Mar. 2, 2018

(87) PCT Pub. No.: WO2017/150651

PCT Pub. Date: Sep. 8, 2017

(65) Prior Publication Data

US 2019/0316498 A1 Oct. 17, 2019

(30) Foreign Application Priority Data

Mar. 3, 2016 (JP) ..... 2016-041108

(51) Int. Cl.
*F01M 1/16* (2006.01)
*F01M 1/20* (2006.01)
(Continued)

(52) U.S. Cl.
CPC ..... *F01M 1/16* (2013.01); *F01L 1/3442* (2013.01); *F01M 1/02* (2013.01); *F01M 1/06* (2013.01);
(Continued)

(58) Field of Classification Search
CPC .... F01M 1/16; F01M 1/02; F01M 2001/0215; F01M 1/12; F01M 1/20; F01M 2001/123;
(Continued)

(56) References Cited

U.S. PATENT DOCUMENTS 4,674,451 A 6/1987 Rembold et al.
2004/0099240 A1* 5/2004 Resh ..... F01M 11/02 123/196 R
2014/0060677 A1 3/2014 Wi et al.

FOREIGN PATENT DOCUMENTS

JP S59-142407 U 9/1984
JP S61-229912 A 10/1986
(Continued)

OTHER PUBLICATIONS

International Search Report issued in PCT/JP2017/008225; dated May 23, 2017.

*Primary Examiner* — Jacob M Amick
(74) *Attorney, Agent, or Firm* — Studebaker & Brackett PC

(57) ABSTRACT

Disclosed herein is an oil supply device for an internal combustion engine, which includes a control unit that controls activation of an electric oil pump and that functions as either a reserve oil level estimator for estimating the level of oil reserved in auxiliary chambers or a reserve oil level detector for detecting the level of the oil reserved there. When it is estimated or detected that the level of the oil reserved in the auxiliary chambers has become equal to or less than a predetermined reserve oil level while the internal combustion engine is OFF, the control unit performs an oil replenishment control to replenish the auxiliary chambers with the oil by activating the electric oil pump.

19 Claims, 7 Drawing Sheets

(51) Int. Cl.

| | |
|---|---|
| ***F01M 1/12*** | (2006.01) |
| ***F01L 1/344*** | (2006.01) |
| ***F01M 1/02*** | (2006.01) |
| ***F01M 1/06*** | (2006.01) |

(52) U.S. Cl.
CPC ..... *F01M 1/12* (2013.01); *F01M 1/20* (2013.01); *F01L 2001/34423* (2013.01); *F01M 2001/0215* (2013.01); *F01M 2001/123* (2013.01)

(58) Field of Classification Search
CPC ..... F01M 2011/0433; F01M 11/06; F01M 11/061; F01M 2011/068; F01M 11/12; F01L 1/3442
See application file for complete search history.

(56) References Cited

FOREIGN PATENT DOCUMENTS

| | | | |
|---|---|---|---|
| JP | H03-249315 | A | 11/1991 |
| JP | 2008-308998 | A | 12/2008 |
| JP | 2014-004791 | A | 3/2014 |
| JP | 2014-047921 | A | 3/2014 |

* cited by examiner

OIL SUPPLY DEVICE OF INTERNAL COMBUSTION ENGINE

TECHNICAL FIELD

The present disclosure relates an oil supply device for an internal combustion engine.

BACKGROUND ART

Oil supply devices for supplying oil to respective parts of an internal combustion engine have been known in the art.

Patent Document 1 discloses a liquid-operated unit, which includes a high pressure chamber, an intermediate pressure chamber, and a low pressure chamber as a reservoir for a liquid pressure medium, and in which the low pressure chamber communicates with the intermediate pressure chamber through a diaphragm opening running through a partition wall between the low pressure chamber and the intermediate pressure chamber.

Meanwhile, a liquid-operated variable valve mechanism for controlling the activation of intake and exhaust valves of an engine (internal combustion engine) with a liquid medium has also been known in the art.

Patent Document 2 discloses a variable valve mechanism (corresponding to a liquid-operated variable valve mechanism), which includes a hydraulic unit having an internal oil passage filled with an oil functioning as a power transmission medium, in which the oil passage is interposed between a rotating cam and an exhaust valve or an intake valve, and which is able to freely control the opening/closing timing and degree of the valve by opening and closing a solenoid valve provided for the oil passage to increase and decrease the flow rate of the oil flowing through the oil passage.

CITATION LIST

Patent Documents

PATENT DOCUMENT 1: Japanese Unexamined Patent Publication No. 2014-47921

PATENT DOCUMENT 2: Japanese Unexamined Patent Publication No. 2008-308998

SUMMARY

Technical Problem

As an example of the liquid-operated variable valve mechanism disclosed in Patent Document 2, there is a hydraulically-actuated variable valve mechanism that uses oil as a liquid medium. This hydraulically-actuated variable valve mechanism is supplied, through an oil supply passage, with the oil from a mechanical oil pump to be operated by an internal combustion engine.

In a situation where the mechanical oil pump supplies the oil to the hydraulically-actuated variable valve mechanism, while the internal combustion engine is OFF, the mechanical oil pump is not running, and therefore, supplies no oil to the hydraulically-actuated variable valve mechanism. When the mechanical oil pump stops running, some oil will still be left in the oil supply passage, provided that the internal combustion engine has just been turned OFF. However, if the internal combustion engine is kept OFF for a long time, the oil in the oil supply passage will leak through a gap in the hydraulically-actuated variable valve mechanism, for example. As a result, eventually, there will be no oil left in the oil supply passage. Once the oil has been depleted in the oil supply passage in this manner, there will be a significant decline in the response of the internal combustion engine, because when the internal combustion engine is started, the hydraulically-actuated variable valve mechanism cannot be actuated until the oil supply passage is replenished with the oil in the first place.

To avoid such a situation, as in the liquid-operated unit disclosed in Patent Document 1, for example, a low pressure chamber to be a reservoir may be formed, and the hydraulically-actuated variable valve mechanism may be actuated with the oil reserved in the reservoir when the internal combustion engine is started.

However, while the internal combustion engine is OFF, the oil will also leak through a gap in the hydraulically-actuated variable valve mechanism and other gaps. Thus, the oil will run short in the inner space of the hydraulically-actuated variable valve mechanism as well. The loss of the oil from inside the hydraulically-actuated variable valve mechanism may be recovered with the oil reserved in the reservoir. However, if the internal combustion engine were kept OFF for too long a time, the oil in the reservoir could be depleted. To deal with such a situation, the reservoir should be designed to have an increased volume. Generally, however, there is a limit to the reservoir's volume depending on the size of the internal combustion engine. That is why it is difficult to deal with such a situation where the engine is kept OFF for a long time just by providing a reservoir.

In view of the foregoing background, it is therefore an object of the present invention to reduce such a decline in the response of an internal combustion engine with a hydraulically-actuated variable valve mechanism when the internal combustion engine is kept OFF for a long time.

Solution to the Problem

To achieve this object, the present invention provides an oil supply device for an internal combustion engine. The device includes: a hydraulically-actuated variable valve mechanism provided for the internal combustion engine and configured to open and close a valve by hydraulically transmitting a power of a cam, rotating in accordance with an output of the internal combustion engine, to the valve; an electric oil pump operating with power supplied from a storage battery and configured to supply oil to the hydraulically-actuated variable valve mechanism; a variable valve mechanism oil supply passage configured to supply the oil discharged from the electric oil pump to the hydraulically-actuated variable valve mechanism; an oil reservoir arranged halfway along the variable valve mechanism oil supply passage and upstream of the cam, the oil reservoir being configured to reserve the oil discharged from the electric oil pump and to supply the reserved oil to the hydraulically-actuated variable valve mechanism while the internal combustion engine is OFF; a controller configured to control activation of the electric oil pump; and a reserve oil level estimator configured to estimate the level of the oil reserved in the oil reservoir; or a reserve oil level detector configured to detect the level of the oil reserved in the oil reservoir. When the reserve oil level estimator estimates, or the reserve oil level detector detects, that the level of the oil reserved in the oil reservoir has become equal to or less than a predetermined reserve oil level while the internal combustion engine is OFF, the controller performs an oil replenishment control to replenish the oil reservoir with the oil by activating the electric oil pump.

According to this configuration, even when the internal combustion engine is kept OFF for a long time, the level of the oil reserved in the oil reservoir will still be more than a predetermined reserve oil level. This reduces a decline in the response of the internal combustion engine when the internal combustion engine is kept OFF for a long time.

Specifically, when the reserve oil level estimator estimates, or the reserve oil level detector detects, that the level of the oil reserved in the oil reservoir has become equal to or less than a predetermined reserve oil level while the internal combustion engine is OFF (i.e., on determining the level of the oil reserved in the oil reservoir, either estimated by the reserve oil level estimator or detected by the reserve oil level detector, to be equal to or less than the predetermined reserve oil level), the controller performs an oil replenishment control to replenish the oil reservoir with the oil by activating the electric oil pump.

In this case, setting the predetermined reserve oil level to be large enough to actuate the hydraulically-actuated variable valve mechanism allows the hydraulically-actuated variable valve mechanism to be replenished with the oil reserved in the oil reservoir, even if the oil has once been depleted in the variable valve mechanism oil supply passage and the hydraulically-actuated variable valve mechanism while the internal combustion engine is kept OFF for a long time. This allows the hydraulically-actuated variable valve mechanism to be actuated no sooner than the internal combustion engine is started. Consequently, a decline in the response of the internal combustion engine is reducible while the internal combustion engine is kept OFF for a long time.

In one embodiment of the engine oil supply device, the device further includes an oil viscosity estimator configured to estimate a viscosity of the oil discharged from the electric oil pump. The electric oil pump is able to change a discharge pressure of the oil according to the magnitude of the power supplied from the storage battery. When performing the oil replenishment control, the controller determines the magnitude of the power supplied to the electric oil pump based on the oil viscosity estimated by the oil viscosity estimator while the internal combustion engine is still running but on the verge of being turned OFF, and operates the electric oil pump with the determined magnitude of power.

Generally speaking, to allow the oil discharged from an oil pump to reach a predetermined site, the higher the viscosity of the oil is, the greater the power to be supplied to the electric oil pump should be, in order to discharge the oil at a high discharge pressure or to operate the electric oil pump for an extended period of time. That is to say, the higher the viscosity of the oil is, the greater the magnitude of the power supplied to the electric oil pump should be.

Thus, the controller changes, based on the oil viscosity estimated by the oil viscosity estimator, at least one of the magnitude or duration of the power supplied to the electric oil pump, and determines, based on the changed power and/or duration, the magnitude of the power supplied to the electric oil pump, thus operating the electric oil pump with the power of the determined magnitude. This allows the electric oil pump to be operated with power appropriately determined according to the viscosity of the oil, thus minimizing the power dissipation of the storage battery.

The engine oil supply device may include the reserve oil level estimator configured to estimate the level of the oil reserved in the oil reservoir based on the amount of time that has actually passed since the internal combustion engine was turned OFF, and the controller may perform the oil replenishment control when the level of the oil reserved in the oil reservoir, estimated by the reserve oil level estimator, becomes equal to or less than the predetermined reserve oil level.

That is to say, the leakage of the oil while the internal combustion engine is OFF is caused due to the existence of a gap between an oil passage and a valve, for example. Thus, the rate of decrease in the level of the oil reserved in the oil reservoir per unit time may be determined by the configuration of the hydraulically-actuated variable valve mechanism. Therefore, the level of the oil reserved in the oil reservoir may be estimated based on the amount of time that has actually passed since the internal combustion engine was turned OFF.

Thus, the level of the oil reserved in the oil reservoir is estimated based on the amount of time that has actually passed since the internal combustion engine was turned OFF, and the oil replenishment control starts to be performed when the estimated level of the oil reserved in the oil reservoir becomes equal to or less than the predetermined reserve oil level. This allows the oil replenishment control to be performed appropriately at a timing when the level of the oil reserved in the oil reservoir becomes equal to or less than the predetermined reserve oil level.

In the oil supply device for the internal combustion engine, when performing the oil replenishment control, the controller may have the oil supplied continuously until the oil reservoir is replenished with the oil and then stop operating the electric oil pump.

According to this configuration, when the oil replenishment control is performed, the oil reservoir is replenished with the oil, which maximizes the length of the interval before the oil replenishment control is needed next time. Consequently, a decline in the response of the internal combustion engine is reducible even more effectively while the internal combustion engine is kept OFF for a long time.

The oil supply device for the internal combustion engine, configured to supply the oil continuously until the oil reservoir is replenished with the oil when performing the oil replenishment control, may further include a variable valve mechanism oil pressure detector configured to detect an oil pressure in the variable valve mechanism oil supply passage. When the oil pressure detected by the variable valve mechanism oil pressure detector becomes equal to or greater than a predetermined oil pressure, the controller may determine that the oil reservoir is replenished with the oil.

That is to say, after the oil reservoir is replenished with the oil, the variable valve mechanism oil supply passage will be replenished with the oil. When the variable valve mechanism oil supply passage is replenished with the oil, the oil pressure will rise in the variable valve mechanism oil supply passage. That is why when the oil pressure in the variable valve mechanism oil supply passage becomes equal to or greater than a predetermined oil pressure, the oil reservoir will already be replenished with the oil.

Therefore, by determining that the oil reservoir is replenished with the oil when the oil pressure in the variable valve mechanism oil supply passage becomes equal to or greater than the predetermined oil pressure, the controller is able to appropriately determine the timing when the oil reservoir is replenished with the oil. This minimizes the power to be dissipated from the storage battery until the oil reservoir is replenished with the oil.

The oil supply device for the internal combustion engine may further include a mechanical oil pump operating with power generated by the internal combustion engine and configured to supply the oil to a lubricating part of the internal combustion engine. The electric oil pump may supply the oil only to the hydraulically-actuated variable valve mechanism without supplying the oil to the lubricating part.

According to this configuration, the electric oil pump supplies the oil only to the hydraulically-actuated variable valve mechanism. Thus, only a power for meeting the oil pressure required for the hydraulically-actuated variable valve mechanism needs to be supplied to the electric oil pump. This further reduces the power dissipation of the storage battery.

In one embodiment of the oil supply device for the internal combustion engine including the mechanical oil pump, the device may further include: a variable valve mechanism oil pressure detector configured to detect an oil pressure in the variable valve mechanism oil supply passage; a lubricating part oil supply passage configured to supply the oil discharged from the mechanical oil pump to the lubricating part; a lubricating part oil pressure detector configured to detect an oil pressure in the lubricating part oil supply passage; an auxiliary oil supply passage configured to connect the variable valve mechanism oil supply passage and the lubricating part oil supply passage together; and a check valve provided for the auxiliary oil supply passage and configured to allow the oil to flow from the lubricating part oil supply passage into the variable valve mechanism oil supply passage and prevent the oil from flowing from the variable valve mechanism oil supply passage into the lubricating part oil supply passage. The valve may include an intake valve provided for an intake-side part of the internal combustion engine and an exhaust valve provided for an exhaust-side part of the internal combustion engine. The hydraulically-actuated variable valve mechanism may be provided for each of the intake-side and exhaust-side parts. The variable valve mechanism oil supply passage may include an intake-side communicating oil passage for supplying the oil to the intake-side hydraulically-actuated variable valve mechanism, and an exhaust-side communicating oil passage for supplying the oil to the exhaust-side hydraulically-actuated variable valve mechanism. The lubricating part oil pressure detector may be arranged downstream of the check valve on the lubricating part oil supply passage, and the variable valve mechanism oil pressure detector may be arranged downstream of the check valve and upstream of the intake-side communicating oil passage and the exhaust-side communicating oil passage on the variable valve mechanism oil supply passage.

According to this configuration, provision of the check valve prevents the oil from flowing from the variable valve mechanism oil supply passage into the lubricating part oil supply passage. This allows the oil discharged from the electric oil pump to be reliably supplied only to the hydraulically-actuated variable valve mechanism.

In addition, arranging the variable valve mechanism oil pressure detector and the lubricating part oil pressure detector downstream of the check valve enables accurate detection of the pressure of the oil supplied to the hydraulically-actuated variable valve mechanism through the variable valve mechanism oil supply passage and the pressure of the oil supplied to the lubricating part through the lubricating part oil supply passage.

In another embodiment of the oil supply device for the internal combustion engine, the hydraulically-actuated variable valve mechanism may include: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the magnitude of the oil pressure transmitted from the first transmission chamber to the second transmission chamber and a timing of transmitting the oil pressure from the first transmission chamber to the second transmission chamber. The variable valve mechanism may adjust, using the oil pressure control valve, the degree and timing of opening and closing the valve.

In this particular embodiment, the oil pressure control valve may be connected to the oil reservoir, the first transmission chamber, and the second transmission chamber and may be able to shift between an opened state in which the oil pressure control valve allows the oil reservoir and the second transmission chamber to communicate with each other and a closed state in which the oil pressure control valve cuts off communication between the oil reservoir and the second transmission chamber. The hydraulically-actuated variable valve mechanism may transmit the oil pressure from the first transmission chamber to the second transmission chamber when the oil pressure control valve is in the closed state and need not transmit the oil pressure from the first transmission chamber to the second transmission chamber when the oil pressure control valve is in the opened state.

According to this configuration, the hydraulically-actuated variable valve mechanism includes: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the transmission of the oil pressure from the first transmission chamber to the second transmission chamber. Thus, normally actuating the hydraulically-actuated variable valve mechanism requires filling, with the oil, the first transmission chamber, the second transmission chamber, and the oil passage coupling the first and second transmission chambers together and including the oil pressure control valve. That is why providing the oil reservoir allows the first transmission chamber, the second transmission chamber, and the oil passage to be filled with the oil even if the internal combustion engine is kept OFF for a long time, thus effectively reducing a decline in the response of the internal combustion engine. In addition, the oil pressure control valve of the hydraulically-actuated variable valve mechanism enables arbitrary adjustment of the timing and degree of opening and closing the valve as well.

Advantages of the Invention

As can be seen from the foregoing description, an oil supply device for an internal combustion engine according to the present invention includes a reserve oil level estimator for estimating a level of an oil reserved in an oil reservoir or a reserve oil level detector for detecting the level of the oil reserved there. When the reserve oil level estimator estimates, or the reserve oil level detector detects, that the level of the oil reserved in the oil reservoir has become equal to or less than a predetermined reserve oil level while the internal combustion engine is OFF, the controller performs an oil replenishment control to replenish the oil reservoir with the oil by activating the electric oil pump. This reduces a decline in the response of the internal combustion engine when the internal combustion engine is kept OFF for a long time.

DESCRIPTION OF EMBODIMENTS

Embodiments of the present invention will now be described in detail with reference to the drawings.

Figure 1:
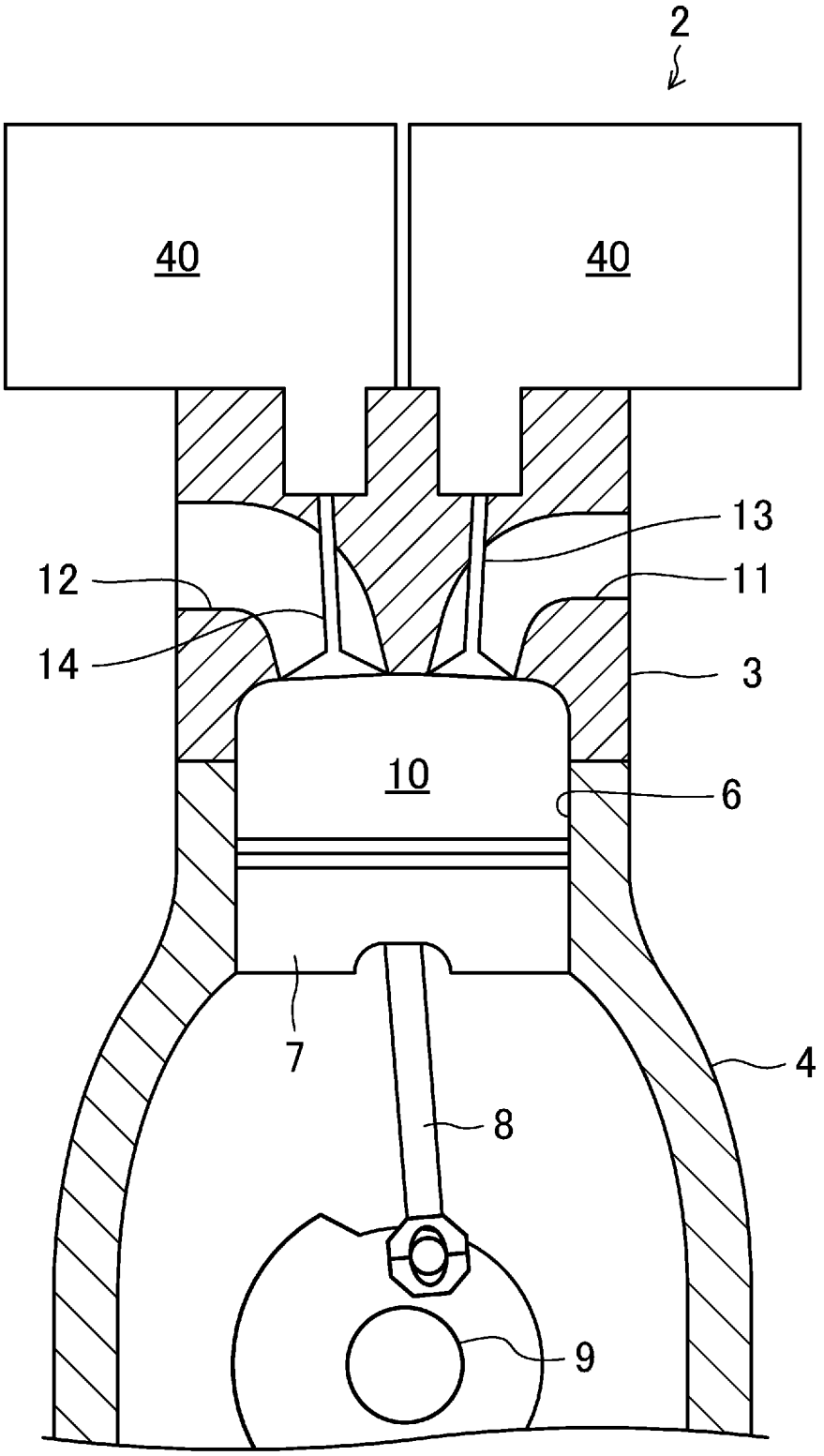
FIG. 1 A cross-sectional view schematically illustrating a configuration for an engine with an oil supply device according to an embodiment.

FIG. 1 illustrates an engine (internal combustion engine) 2 including an oil supply device 1 according to an embodiment. The engine 2 is an inline four-cylinder gasoline engine in which first to fourth cylinders are sequentially arranged in series in the direction coming out of the paper of FIG. 1 (hereinafter referred to as a "cylinder arrangement direction"), and is mounted on a vehicle such as an automobile.

The engine 2 includes a cylinder head 3, a cylinder block 4, a crankcase (not shown), and an oil pan 5 (see FIG. 3), which are vertically coupled to one another.

In the cylinder block 4, four cylinder bores 6, corresponding to the first through fourth cylinders, respectively, are arranged side by side in the cylinder arrangement direction. In each of those cylinder bores 6, housed is a piston 7, which is slidable in the cylinder bore 6. The piston 7 is coupled to a crankshaft 9 supported on the crankcase with a connecting rod 8. Also, inside each cylinder bore 6, the cylinder bore 6, the piston 7, and the cylinder head 3 define a combustion chamber 10.

The cylinder head 3 has an intake port 11 and an exhaust port 12 which are open to the combustion chamber 10. An intake valve 13 and an exhaust valve 14, which open/close the intake port 11 and the exhaust port 12, respectively, are provided for the intake and exhaust ports 11 and 12, respectively. The intake valve 13 and the exhaust valve 14 are biased in a closing direction by springs. Making the intake valve 13 or the exhaust valve 14 enter the combustion chamber 10 against this biasing force opens the intake port 11 or the exhaust port 12.

To open and close these intake and exhaust valves 13, 14, at least one valve opening/closing mechanism, functioning as a variable valve mechanism, is provided for each of the cylinders. In this embodiment, a hydraulically-actuated variable valve opening/closing mechanism 40, functioning as a hydraulically-actuated variable valve mechanism to open and close the intake valve 13, is arranged closer to the intake port 11 of the cylinder head 3. In addition, a hydraulically-actuated variable valve opening/closing mechanism 40, functioning as a hydraulically-actuated variable valve mechanism to open and close the exhaust valve 14, is arranged closer to the exhaust port 12 of the cylinder head 3. Optionally, the hydraulically-actuated valve opening/closing mechanism 40 may be provided for only one of the intake valve 13 or the exhaust valve 14.

Figure 2:
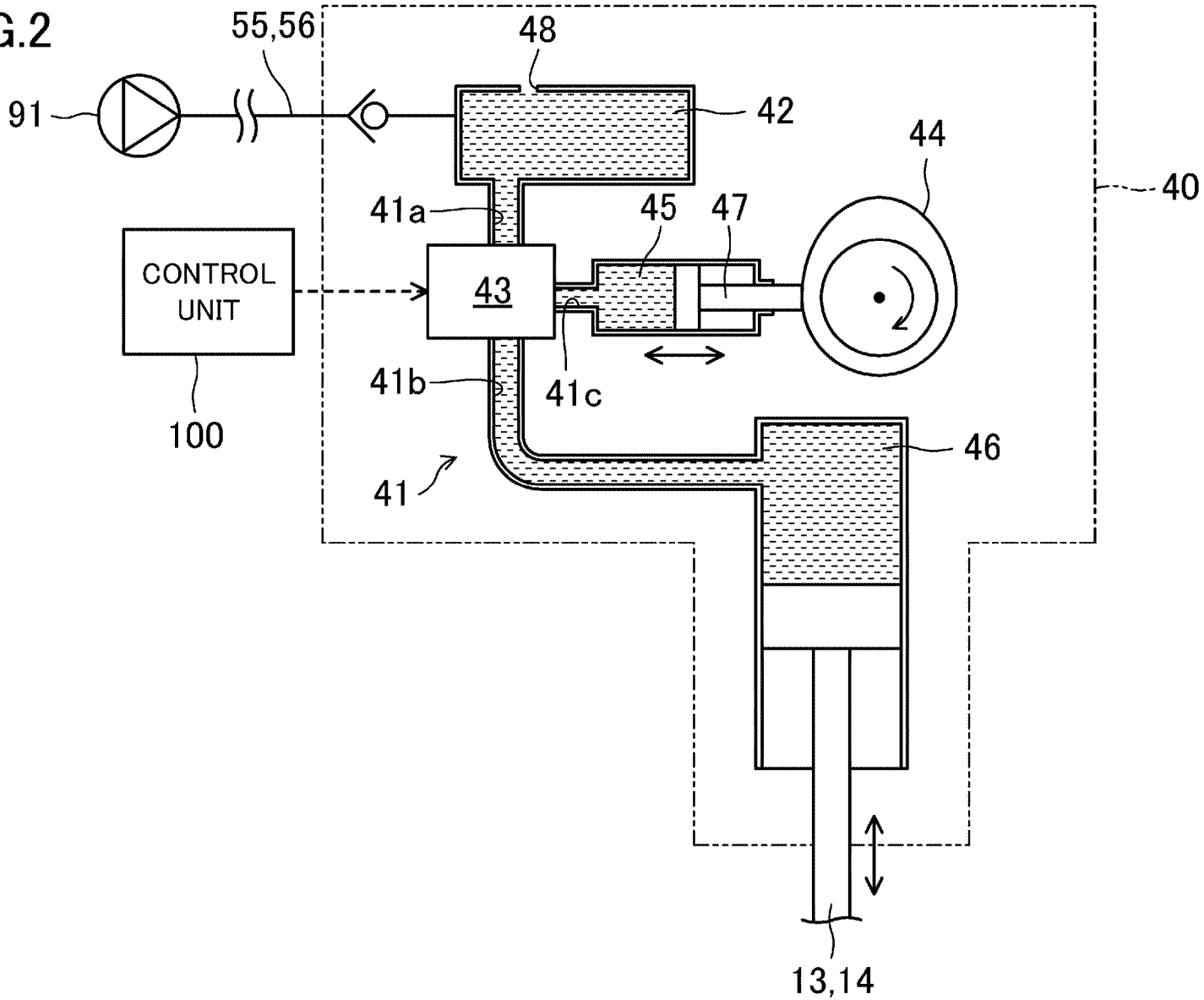
FIG. 2 A schematic representation illustrating a hydraulically-actuated variable valve opening/closing mechanism.

FIG. 2 illustrates a hydraulically-actuated variable valve opening/closing mechanism 40 for opening and closing the intake valve 13 or the exhaust valve 14. The hydraulically-actuated variable valve opening/closing mechanism 40 includes a valve oil supply passage 41, an auxiliary chamber (oil reservoir) 42, and a valve oil pressure control valve 43. This mechanism is configured to open and close the intake valve 13 or the exhaust valve 14 by having the power of a cam 44, rotating in accordance with the output of the engine 2, transmitted to the valve through the oil. This hydraulically-actuated variable valve opening/closing mechanism 40 has the ability to finely and continuously control the timing and degree of opening and closing the valve by regulating the oil pressure. The valve oil supply passage 41 and the auxiliary chamber 42 are provided in a block-shaped valve body (not shown), because a high pressure is built up inside the oil supply passage 41 and the auxiliary chamber 42.

The valve oil supply passage 41 includes: an auxiliary chamber oil passage 41*a* connected to the auxiliary chamber 42; a second transmission chamber oil passage 41*b* connected to the second transmission chamber 46 in order to transmit the oil pressure to the intake valve 13 or the exhaust valve 14; and a first transmission chamber oil passage 41*c* connected to the first transmission chamber 45 in order to make the cam's 44 power act on the oil. The respective oil passages 41*a*-41*c* of the valve oil supply passage 41 are connected together via the valve oil pressure control valve 43. Specifically, each of these oil passages 41*a*-41*c* has one end thereof connected to its associated chamber 42, 46, 45 and the other end thereof connected in common to the valve oil pressure control valve 43. Note that the auxiliary chamber oil passage 41*a* is an implementation of the variable valve mechanism oil supply passage for supplying the oil to the hydraulically-actuated variable valve opening/closing mechanism 40.

The auxiliary chamber 42 is a chamber for reserving the oil to be supplied to respective parts (such as the valve oil supply passage 41) of the hydraulically-actuated variable valve opening/closing mechanism 40. The auxiliary chamber 42 of the intake-side hydraulically-actuated variable valve opening/closing mechanism 40 is connected to an intake-side communicating oil passage 55 branching from a second oil supply passage 52 (to be described later). The auxiliary chamber 42 of the exhaust-side hydraulically-actuated variable valve opening/closing mechanism 40 is connected to an exhaust-side communicating oil passage 56 branching from the same second oil supply passage 52. The oil discharged from an electric oil pump 91 (hereinafter simply referred to as an "electric pump 91") to be described later passes through the intake-side or exhaust-side communicating oil passage 55, 56, flows into the auxiliary chamber 42, and then is supplied to respective parts of the hydraulically-actuated variable valve opening/closing mechanism 40.

The auxiliary chamber 42 plays the role of a reservoir for supplying the oil to the respective parts of the hydraulically-actuated variable valve opening/closing mechanism 40 while the engine 2 is OFF, for example.

That is to say, in the hydraulically-actuated variable valve opening/closing mechanism 40, there may be a gap between the intake valve 13 or the exhaust valve 14 and the second transmission chamber 46, for example, and while the engine 2 is OFF, the oil may leak through the gap and may be depleted in each of those parts of the hydraulically-actuated variable valve opening/closing mechanism 40. Once the oil has been depleted in the respective parts of the hydraulically-actuated variable valve opening/closing mechanism 40, when the engine 2 is started, the oil pressure cannot be transmitted to the hydraulically-actuated variable valve opening/closing mechanism 40 until these parts are replenished with the oil, thus causing a decline in the response of the engine 2. Therefore, while the engine 2 is OFF, supplying the oil reserved in the auxiliary chamber 42 to the respective parts of the hydraulically-actuated variable valve opening/closing mechanism 40 allows those parts of the hydraulically-actuated variable valve opening/closing mechanism 40 to be replenished with the oil. This reduces a decline in the response of the engine 2.

The auxiliary chamber 42 is arranged to be located over the respective parts of the hydraulically-actuated variable valve opening/closing mechanism 40 when the engine 2 is mounted on the vehicle so as to reliably supply the oil to the respective parts of the hydraulically-actuated variable valve opening/closing mechanism 40 while the engine 2 is OFF.

The first transmission chamber 45 transmits the power of reciprocation, varying along with the rotation of the cam surface of the cam 44 synchronous with the crankshaft 9, to the oil in the valve oil supply passage 41 via a power-transmitting piston 47. The oil, to which the power has been transmitted, in turn transmits the power, in the second transmission chamber 46, to the intake valve 13 or the exhaust valve 14.

The valve oil pressure control valve 43 is electrically connected to a control unit 100 as will be described later. Under the control of the control unit 100, the valve oil pressure control valve 43 shifts between a closed state in which the valve oil pressure control valve 43 cuts off communication between the auxiliary chamber oil passage 41*a* and the second transmission chamber oil passage 41*b* and an opened state in which the valve oil pressure control valve 43 allows the auxiliary chamber oil passage 41*a* and the second transmission chamber oil passage 41*b* to communicate with each other. That is to say, keeping the valve oil pressure control valve 43 closed allows the power transmitted from the cam 44 to the first transmission chamber 45 to be transmitted as it is to the second transmission chamber 46 via the oil, thus opening or closing the intake valve 13 or the exhaust valve 14. On the other hand, keeping the valve oil pressure control valve 43 opened allows the oil in the second transmission chamber oil passage 41*b* to flow into the auxiliary chamber 42 through the auxiliary chamber oil passage 41*a* and then flow out of the hydraulically-actuated variable valve opening/closing mechanism 40 through a communication hole 48 of the auxiliary chamber 42. Thus, the power transmitted from the cam 44 to the oil in the first transmission chamber 45 is no longer transmitted to the second transmission chamber 46. As a result, the opening and closing operation of the intake valve 13 or the exhaust valve 14 stops and the intake port 11 or the exhaust port 12 is kept closed.

By adjusting the timing and/or duration of operating the valve oil pressure control valve 43, the hydraulically-actuated variable valve opening/closing mechanism 40 is able to vary the timing and degree of opening and closing the intake valve 13 or the exhaust valve 14. That is to say, this hydraulically-actuated variable valve opening/closing mechanism 40 enables combustion under an optimum condition, which would achieve higher fuel efficiency and various other benefits.

Figure 3:
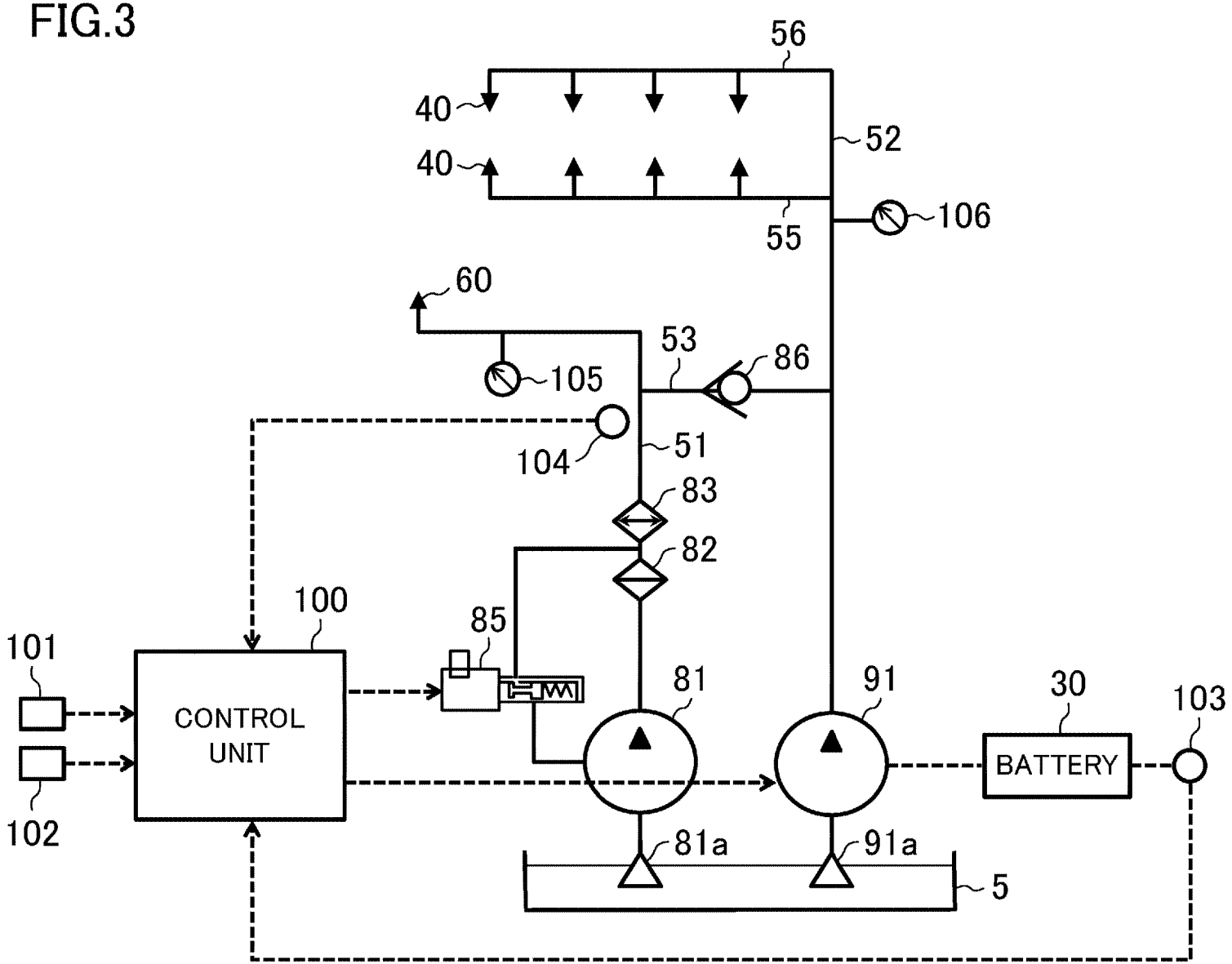
FIG. 3 Illustrates an oil supply system for an engine.

Next, the oil supply device 1 for supplying the oil to the engine 2 will be described in detail with reference to FIG. 3.

The oil supply device 1 includes: a mechanical oil pump 81 (hereinafter referred to as a "mechanical pump 81") to be operated with the rotational force of the crankshaft 9; an electric pump 91 to be operated with the power supplied from a battery (storage battery) 30 of the vehicle; a first oil supply passage (lubricating part oil supply passage) 51 connected to the mechanical pump 81 to guide the oil that has had its pressure raised by the mechanical pump 81 mainly to a lubricating part 60 of the engine 2; a second oil supply passage 52 arranged in parallel with the first oil supply passage 51 and connected to the electric pump 91 to guide the oil that has had its pressure raised by the electric pump 91 mainly to the hydraulically-actuated variable valve opening/closing mechanisms 40 of the engine 2; and an auxiliary oil supply passage 53 connecting the first and second oil supply passages 51, 52 together. Note that the lubricating part 60 includes a bearing metal for a bearing portion for rotatably supporting the crankshaft 9, a bearing metal arranged in a crank pin to which the connecting rod 8 is coupled rotatably, an oil jet for cooling the piston, and a bearing portion for a cam journal (not shown).

The mechanical pump 81 is a known variable-displacement oil pump for varying the rate of the oil discharged from the mechanical pump 81 by changing the volume of a pump chamber inside the mechanical pump 81. Although not shown, the mechanical pump 81 includes a pressure chamber for changing the volume of the pump chamber, and is configured to vary the rate of the oil discharged from the mechanical pump 81 according to the pressure (or the amount) of the oil supplied to the pressure chamber.

The electric pump 91 is an oil pump to be operated in accordance with a control signal supplied from the control unit 100 to be described later. Although not shown, the electric pump 91 includes a motor, which drives the electric pump's drive shaft in rotation. The motor is electrically connected to the battery 30 provided for the vehicle. In accordance with the control signal, a predetermined quantity of power (which is the product of the power and the time) required to discharge the oil at a desired rate from the electric pump 91 is supplied from the battery 30 to the motor, thus operating the electric pump 91. That is to say, the electric pump 91 is configured to vary the discharge pressure of the oil according to the magnitude of the power supplied from the battery 30 to the motor. Note that the battery 30 stores power for driving a power driver such as the electric pump 91 or a starter motor, which needs to be activated to start the engine 2. The battery 30 stores (i.e., is charged with) the electricity that a power generator (not shown) generates when driven by the engine 2.

The mechanical pump 81 and the electric pump 91 are arranged in the engine 2 so as to be either housed in the oil pan 5 of the engine 2 or attached to the outer wall of the oil pan 5. Oil strainers 81*a*, 91*a* of the mechanical pump 81 and electric pump 91 are immersed in the oil reserved in the common oil pan 5, and suck the oil reserved in the oil pan 5 to have their pressure raised independently of each other. After that, the mechanical pump 81 discharges the oil into the first oil supply passage 51, and the electric pump 91 discharges the oil into the second oil supply passage 52.

The first oil supply passage 51, the second oil supply passage 52, and the auxiliary oil supply passage 53 are each implemented as a pipe and a channel cut through the cylinder head 3 and the cylinder block 4.

The first oil supply passage 51 has one end thereof connected to the discharge port of the mechanical pump 81 and extends in the cylinder line direction in the cylinder block 4. An oil filter 82 and an oil cooler 83 are arranged in this order on the first oil supply passage 51 such that the oil filter 82 is located closer to the mechanical pump 81 than the oil cooler 83 is. That is to say, the oil discharged from the mechanical pump 81 into the first oil supply passage 53 is filtered by the oil filter 82, has its temperature adjusted by the oil cooler 83, and then is supplied to the lubricating part 60. In addition, provided downstream of the oil cooler 83 and upstream of the lubricating part 60 on the first oil supply passage 51 are an oil temperature sensor 104 for detecting the temperature of the oil flowing through the first oil supply passage 51 and a first oil pressure sensor (lubricating part oil pressure detector) 105 for detecting the oil pressure in the first oil supply passage 51.

Also, from the oil supply passage between the oil filter 82 and the oil cooler 83 on the first oil supply passage 51, branched is a control oil passage 54, which is connected to the pressure chamber of the mechanical pump 81 via an oil pressure control valve 85 for adjusting the rate of the oil discharged from the mechanical pump 81 depending on the operational state of the engine 2. Part of the oil in the first oil supply passage 51 passes through the control oil passage 54, has its oil pressure adjusted by the oil pressure control valve 85, and then flows into the pressure chamber of the mechanical pump 81. That is to say, the oil pressure control valve 85 adjusts the oil pressure in the pressure chamber.

The oil pressure control valve 85 is implemented as a linear solenoid valve in this embodiment, and adjusts the amount of the oil supplied to the pressure chamber according to the duty ratio of a control signal to be input depending on the operational state of the engine 2, thereby controlling the rate of the oil discharged from the mechanical pump 81. The linear solenoid valve is configured to supply, when opened, the oil to the pressure chamber of the mechanical pump 81. The configuration of the linear solenoid valve itself is already known, and will not be described herein.

The second oil supply passage 52 has one end thereof connected to the discharge port of the electric pump 91 and extends from the cylinder block 4 toward the cylinder head 3. The second oil supply passage 52 is arranged in parallel with the first oil supply passage 51. From the second oil supply passage 52, branched are an intake-side communicating oil passage 55 for supplying the oil to the intake-side hydraulically-actuated variable valve opening/closing mechanism 40 and an exhaust-side communicating oil passage 56 for supplying the oil to the exhaust-side hydraulically-actuated variable valve opening/closing mechanism 40. The intake-side and exhaust-side communicating oil passages 55, 56 extend substantially horizontally between the intake-side and exhaust-side parts inside the cylinder head 3 and are each connected to the auxiliary chamber 42 of their associated hydraulically-actuated variable valve opening/closing mechanism 40. The oil discharged from the electric pump 91 passes through the second oil supply passage 52 and then through the intake-side and exhaust-side communicating oil passages 55, 56, and is supplied to respective parts of the hydraulically-actuated variable valve opening/closing mechanisms 40 via their associated auxiliary chamber 42. That is to say, the second oil supply passage 52 and the intake-side and exhaust-side communicating oil passages 55, 56, as well as the auxiliary chamber oil passage 41*a*, form a variable valve mechanism oil supply passage for supplying the oil to the hydraulically-actuated variable valve opening/closing mechanisms 40.

The second oil supply passage 52 is further provided with a second oil pressure sensor (variable valve mechanism oil pressure detector) 106 for detecting the oil pressure in the second oil supply passage 52.

The auxiliary oil supply passage 53 is an oil supply passage that connects together the first and second oil supply passages 51, 52, which are arranged in parallel with each other, and connects a point of the first oil supply passage 51 downstream of the oil cooler 83 to the second oil supply passage. The auxiliary oil supply passage 53 includes a check valve 86. The check valve 86 is a non-return valve, which allows the oil to flow from the first oil supply passage 51 into the second oil supply passage 52 but prevents the oil from flowing in reverse direction from the second oil supply passage 52 into the first oil supply passage 51. That is to say, if the oil pressure in the first oil supply passage 51 is higher than the oil pressure in the second oil supply passage 52, the check valve 86 opens to allow the oil to flow from the first oil supply passage 51 into the second oil supply passage 52. On the other hand, if the oil pressure in the second oil supply passage 52 is higher than the oil pressure in the first oil supply passage 51, the check valve 86 remains closed, checking the flow of the oil from the second oil supply passage 52 into the first oil supply passage 51.

The oil supplied to respective parts of the engine 2, including the hydraulically-actuated variable valve opening/closing mechanisms 40 and the lubricating part 60, passes through a drain oil passage (not shown), drips into the oil pan 5, and then makes reflux by being pumped by the respective pumps 81, 91.

The oil supply device 1 is controlled by a control unit 100 functioning as a controller. The control unit 100 receives the information detected by various sensors for detecting the operational state of the engine 2. For example, the control unit 100 receives detection results obtained by: a crank angle sensor 101 for detecting the rotational angle of the crankshaft 9; an accelerator position sensor 102 for detecting an accelerator position, i.e., how deep the accelerator pedal has been depressed by an occupant of the vehicle; a battery voltage sensor 103 functioning as a battery level detector for detecting the voltage of the battery 30; the oil temperature sensor 104 for detecting the temperature of the oil in the first oil supply passage 51; the first oil pressure sensor 105 for detecting the pressure of the oil in the first oil supply passage 51; the second oil pressure sensor 106 for detecting the pressure of the oil in the second oil supply passage 52; and other sensors. The control unit 100 detects the engine speed in accordance with the detection signal of the crank angle sensor 101 and also detects the engine load in accordance with the detection signal of the accelerator position sensor 102.

The control unit 100 is a controller including a known microcomputer as a base element, and includes: a signal input section for receiving detection signals from various sensors (such as the crank angle sensor 101, the accelerator position sensor 102, the battery voltage sensor 103, the oil temperature sensor 104, the first oil pressure sensor 105, and the second oil pressure sensor 106); an arithmetic section for performing arithmetic operations involved with the control; a signal output section for outputting a control signal to devices under control (e.g., the electric pump 91); and a storage section for storing programs and data (e.g., a hydraulic control map) required for the control.

As in the control over the oil pressure control valve 85, the control unit 100 also transmits a control signal, of which the duty ratio varies according to the operational state of the engine 2, to the electric pump 91 to control the quantity of the power supplied to the electric pump 91 (more specifically, the motor of the electric pump 91) and thereby control the discharge rate of the electric pump 91. For example, if the duty ratio represents the ratio of the energized period of the motor to one cycle time, the larger the duty ratio is, the greater the quantity of the power supplied to the motor becomes. Consequently, the rate of discharge by the electric pump 91 per cycle time increases.

In this case, while the engine 2 is OFF, the control unit 100 does not have to actuate any of the hydraulically-actuated variable valve opening/closing mechanisms 40. Therefore, basically, the control unit 100 stops operating the electric pump 91 with supply of power from the battery 30 to the electric pump 91 discontinued. Even if the electric pump 91 stops operating in this manner while the engine 2 is OFF, the oil will still be supplied from the auxiliary chambers 42 to the respective parts of the hydraulically-actuated variable valve opening/closing mechanisms 40, because the oil is reserved in the auxiliary chambers 42 as described above.

However, if the engine 2 is kept OFF for a long time, then the oil reserved in the auxiliary chambers 42 may sometimes be depleted. In addition, if the engine 2 is kept OFF for a long time, the oil may also run out in the intake-side and exhaust-side communicating oil passages 55, 56. Thus, once the oil that has been reserved in the auxiliary chambers 42 is depleted while the engine 2 is OFF, when the engine 2 is started, the hydraulically-actuated variable valve opening/closing mechanisms 40 cannot be actuated normally with the oil pressure transmitted thereto as intended until the intake-side and exhaust-side communicating oil passages 55, 56 and the hydraulically-actuated variable valve opening/closing mechanisms 40 are replenished with the oil. This causes a decline in the response of the engine 2.

In view of this consideration, according to this embodiment, when determining that the level of the oil reserved in the auxiliary chambers 42 has become equal to or less than a predetermined reserve oil level while the engine 2 is OFF, the control unit 100 performs an oil replenishment control to replenish the auxiliary chambers 42 with the oil by activating the electric pump 91.

Specifically, the control unit 100 estimates the level of the oil reserved in the auxiliary chambers 42 while the engine 2 is OFF. When the reserve oil level estimated (hereinafter referred to as "estimated reserve oil level) becomes equal to or less than a predetermined reserve oil level, the control unit 100 performs the oil replenishment control to replenish the auxiliary chambers 42 with the oil by activating the electric pump 91 with power supplied from the battery 30 to the electric pump 91. Note that the predetermined reserve oil level is large enough for the hydraulically-actuated variable valve opening/closing mechanisms 40 to perform the desired valve control when the engine 2 is started.

In this case, based on the viscosity of the oil discharged from the electric pump 91 just before the engine 2 is turned OFF and the amount of time that has actually passed since the engine 2 was turned OFF (hereinafter referred to as an "engine OFF period"), the control unit 100 estimates the level of the oil reserved in the auxiliary chambers 42.

The viscosity of the oil is estimated based on at least one of the temperature or the degree of degradation of the oil. As for the oil temperature, the higher the oil temperature is, the lower the viscosity of the oil tends to be. Meanwhile, the lower the oil temperature is, the higher the viscosity of the oil tends to be. As for the degree of degradation of the oil, the greater the degree of degradation is, the higher the viscosity of the oil tends to be. Meanwhile, the newer the oil is, the lower the viscosity of the oil tends to be. The control unit 100 has two oil viscosity maps plotted with respect to the oil temperature and the degree of degradation of the oil, respectively, in accordance with the relationship described above, and estimates the viscosity of the oil by loading those maps into itself. Thus, the control unit 100 functions as an oil viscosity estimator for estimating the viscosity of the oil.

In estimating the viscosity of the oil, the control unit 100 uses, as the oil temperature, the detection result obtained by the oil temperature sensor 104 and also uses, as the degree of degradation of the oil, the integrated value of the volume of smoke produced just before the engine 2 is turned OFF. Note that although the oil temperature sensor 104 is provided for the first oil supply passage 51, the oil flowing through the first oil supply passage 51 and the oil discharged from the electric pump 91 have been reserved in the same oil pan 5. In addition, since the first and second oil supply passages 51, 52 are arranged in parallel with each other in the engine 2, the temperature of the oil flowing through the second oil supply passage 52 is approximately as high as that of the oil flowing through the first oil supply passage 51. Thus, there will be no problem even if the viscosity of the oil discharged from the electric pump 91 is estimated based on the temperature of the oil flowing through the first oil supply passage 51.

The integrated value of the volume of smoke produced is estimated based on the operational state of the engine 2. It will be described specifically how to estimate the volume of smoke produced. First of all, the control unit 100 receives the engine speed, engine load, and temperature of the combustion chamber 10 detected. As described above, according to this embodiment, the engine speed is detected by the crank angle sensor 101, and the engine load is detected by the accelerator position sensor 102.

In this embodiment, the detection result obtained by the oil temperature sensor 104 is used as the temperature of the combustion chamber 10. The oil temperature has correlation with the temperature of the combustion chamber 10, and therefore, the temperature of the combustion chamber 10 may be calculated based on the oil temperature. Alternatively, the temperature of the combustion chamber 10 may also be calculated based on the temperature of the engine's cooling water or the temperature of the exhaust gas, which also has correlation with the temperature of the combustion chamber 10, instead of the oil temperature.

Then, the control unit 100 makes reference to the pre-stored maps with the engine speed, engine load, and combustion chamber's 10 temperature detected to estimate the volume of smoke produced, and calculate an integrated value by adding the estimated value to the previous result of estimation. In this manner, the integrated value of the volume of the smoke produced is obtained and used to estimate the degree of degradation of the oil.

Note that if the viscosity of the oil is estimated based on both the oil temperature and the degree of degradation of the oil, the viscosity of the oil estimated based on the degree of degradation of the oil may be corrected based on the oil temperature, for example.

Meanwhile, the amount of time that has passed since the engine 2 was turned OFF may be detected by a timer pre-stored in the control unit 100, for example.

Next, it will be described with reference to FIG. 4 how the control unit 100 estimates the level of the oil reserved in the auxiliary chambers 42 based on the estimated oil viscosity just before the engine 2 is turned OFF and on the engine OFF period.

Figure 4:
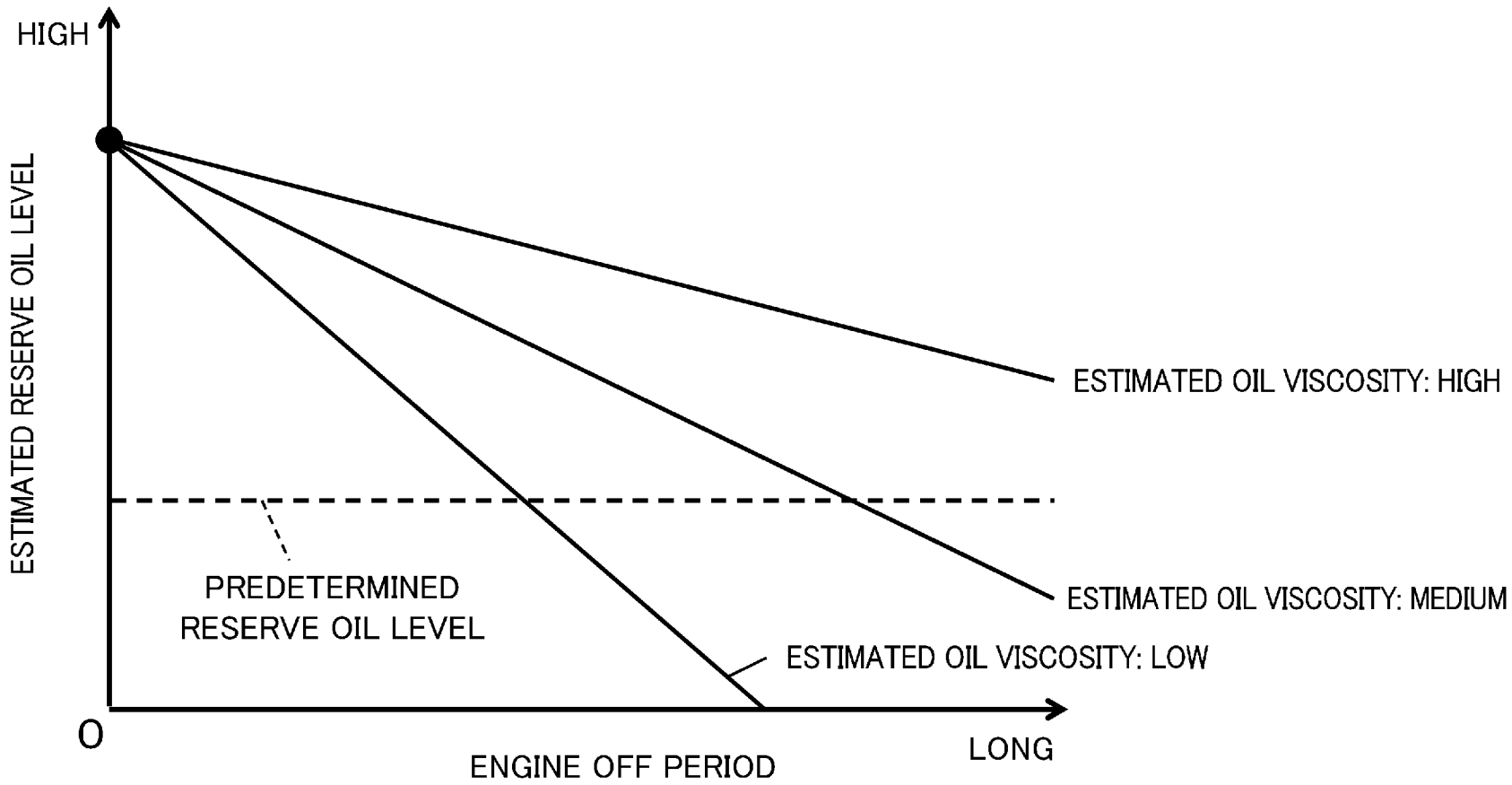
FIG. 4 A map showing how estimated reserve oil levels change with an engine OFF period.

FIG. 4 is an exemplary map showing how to calculate an estimated reserve oil level based on an engine OFF period. In FIG. 4, a point in time when the abscissa goes zero indicates the instant when the engine 2 is turned OFF, and the estimated reserve oil level at that instant represents the oil level in the auxiliary chambers 42 in the full state. Also, in FIG. 4, the solid lines each represent how the estimated reserve oil level at an associated viscosity changes with the duration of the engine OFF period, while the broken line indicates a predetermined reserve oil level.

As time passes by since the engine was turned OFF, an increasing amount of oil leaks out of the hydraulically-actuated variable valve opening/closing mechanisms 40, and the level of the oil reserved in the auxiliary chambers 42 goes on decreasing. In this case, the rate of the decline in the level of the oil reserved in the auxiliary chambers 42 with respect to the duration of the engine OFF period, i.e., the gradient of each line graph in FIG. 4, depends on the configuration of the hydraulically-actuated variable valve opening/closing mechanisms 40 and the estimated oil viscosity. The rate of decline depending on the configuration of the hydraulically-actuated variable valve opening/closing mechanisms 40 may be determined uniformly by the size of the gap between the intake valve 13 or the exhaust valve 14 and the second transmission chamber 46, for example. On the other hand, as for the rate of decline depending on the estimated oil viscosity, the lower the viscosity of the oil is, the more likely the oil leaks. That is why the lower the estimated oil viscosity is, the steeper the gradient of the line graph becomes. The higher the estimated oil viscosity is, the gentler its gradient becomes.

The control unit 100 stores in advance, as the rate of decline depending on the configuration of the hydraulically-actuated variable valve opening/closing mechanisms 40, data about the rate of decline at a reference viscosity (e.g., one of the estimated oil viscosities shown in FIG. 4). The control unit 100 obtains a final rate of decline by correcting the data based on the estimated oil viscosity.

Then, in FIG. 4, the engine OFF period at the intersection between each solid line and the broken line represents an engine OFF period when the estimated reserve oil level becomes equal to or less than the predetermined reserve oil level.

The control unit 100 determines, based on the configuration of the hydraulically-actuated variable valve opening/closing mechanisms 40 and the estimated oil viscosity, the rate of decline in the level of the oil reserved in the auxiliary chambers 42 with respect to the engine OFF period, and estimates the level of the oil reserved in the auxiliary chambers 42 by reference to the map shown in FIG. 4 with the engine OFF period. The control unit 100 performs the oil replenishment control when the estimated reserve oil level becomes equal to or less than the predetermined reserve oil level. As can be seen from the foregoing description, the control unit 100 functions as a reserve oil level estimator.

In this case, when performing the oil replenishment control, the control unit 100 has the oil supplied to the auxiliary chambers 42 continuously until the auxiliary chambers 42 are replenished with the oil and then stops operating the electric pump 91 when the auxiliary chambers 42 are replenished with the oil.

As can be seen, once the auxiliary chambers 42 are replenished with the oil, the length of the interval before the oil replenishment control will be needed next time can be maximized. This reduces the decline in the response of the engine 2 even more effectively when the engine 2 is kept OFF for a long time.

At this point in time, the control unit 100 determines, based on the oil pressure in the second oil supply passage 52 to be detected by the second oil pressure sensor 106, whether or not the auxiliary chambers 42 are replenished with the oil. That is to say, after the auxiliary chambers 42 have been replenished with the oil, the second oil supply passage 52 will be replenished with the oil. When the second oil supply passage 52 is replenished with the oil, the oil pressure in the second oil supply passage 52 will rise. That is why when the oil pressure in the second oil supply passage 52 becomes equal to or higher than the predetermined oil pressure, the auxiliary chambers 42 will be replenished with the oil. Therefore, determining, based on the oil pressure in the second oil supply passage 52, whether or not the auxiliary chambers 42 are replenished with the oil allows for appropriately detecting the timing when the auxiliary chambers 42 are replenished with the oil.

Optionally, the duration for operating the electric pump 91 may be determined based on the estimated level of the oil reserved in the auxiliary chambers 42 and the discharge rate of the electric pump 91. In that case, a decision may be made that the auxiliary chambers 42 are replenished with the oil when the electric pump 91 has been operated for the duration determined.

Also, when performing the oil replenishment control, the control unit 100 determines the quantity of the power supplied from the battery 30 to the electric pump 91 based on an estimated oil viscosity just before the engine 2 is turned OFF, and operates the electric pump 91 with the determined quantity of power.

Generally speaking, the higher the viscosity of oil is, the less smoothly the oil can be discharged from an oil pump. Thus, to allow the oil discharged from the oil pump to reach a predetermined site, the higher the viscosity of the oil is, the higher the discharge pressure of the oil should be or the longer the electric pump 91 should be operated. That is to say, the higher the viscosity of the oil is, the greater the power to be supplied to the electric pump 91 should be, in order to allow the electric pump 91 to discharge the oil at a higher discharge pressure or to operate for an extended period of time. Otherwise, the oil could fail to reach the auxiliary chambers 42 from the electric pump 91.

Figure 5:
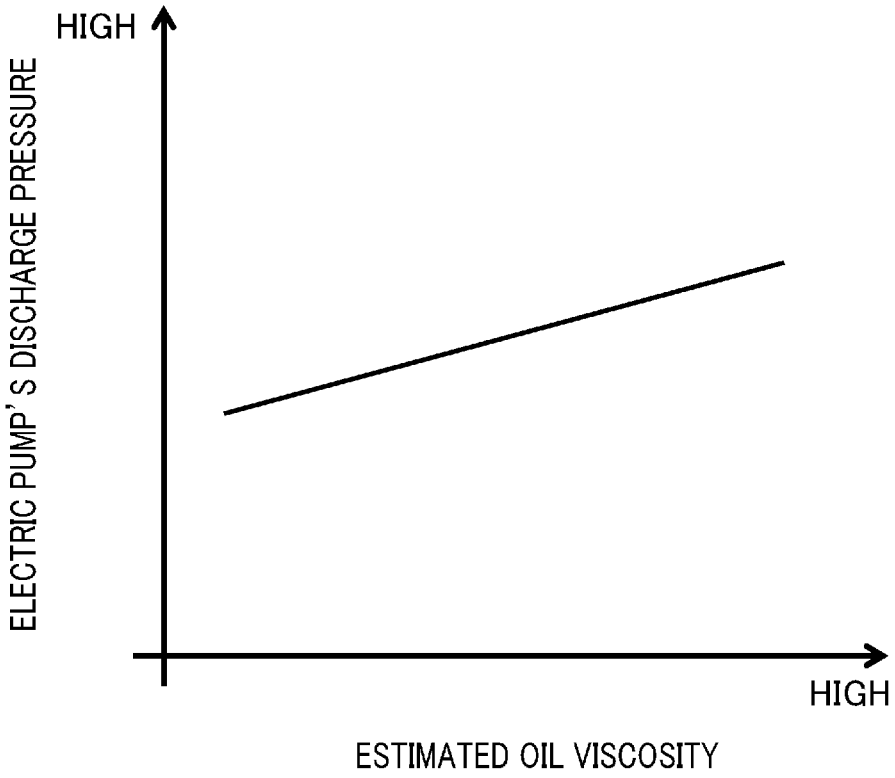
FIG. 5 A graph showing how the discharge pressure of an electric pump changes with an estimated oil viscosity.

Thus, as shown in FIG. 5, as the estimated oil viscosity rises, the control unit 100 increases the magnitude of the power supplied from the battery 30 to the electric pump 91 so as to either raise the discharge pressure of the electric pump 91 or extend the duration of the electric pump 91 operated. This allows the oil to reach the auxiliary chambers 42 even when the oil has high viscosity. Meanwhile, when the oil has low viscosity, this also prevents a redundant quantity of power from being supplied to the electric pump 91, thus minimizing the power dissipation of the battery 30. Optionally, both the power supplied to the electric pump 91 and the duration of the electric pump 91 operated may be changed according to the viscosity of the oil.

Furthermore, if the battery level (i.e., the residual capacity) of the battery 30 detected by the battery voltage sensor 103 is equal to or less than a predetermined capacity, then the control unit 100 decreases the amount of the oil supplied in the oil replenishment control, compared to a situation where the battery level detected is greater than the predetermined capacity. More specifically, the lower the battery level detected is, the more significantly the control unit 100 decreases the amount of the oil supplied to the auxiliary chambers 42.

That is to say, as described above, the power stored in the battery 30 is also supplied to a power driver (not shown) such as a starter motor or an ignition plug, which needs to be activated to start the engine 2. That is why to allow the engine 2 to be started quickly and smoothly enough, the battery 30 needs to have power left which is high enough to activate the power driver. However, once the oil is depleted in the auxiliary chambers 42, the oil needs to be supplied by cranking with the power driver, which causes an increase in the power dissipation to start the engine 2.

Thus, if the battery level detected by the battery voltage sensor 103 is equal to or less than the predetermined capacity, the control unit 100 decreases the amount of the oil supplied to the auxiliary chambers 42 during the oil replenishment control more and more significantly as the battery level detected decreases. In this manner, the control unit 100 substantially prevents the oil from being depleted in the auxiliary chambers 42 while leaving power high enough to activate the power driver. This can reduce an increase in power dissipation to start the engine 2 while still allowing the engine 2 to be started quickly and smoothly enough. Note that the predetermined capacity should be a battery level that is high enough to still activate the power driver, even if the electric pump 91 is operated. Thus, the control unit 100 determines the amount of the oil supplied to the auxiliary chambers 42 so as to keep the battery level high enough to activate the power driver, even after the oil has been supplied to the auxiliary chambers 42 with the electric pump 91 operated.

Figure 6:
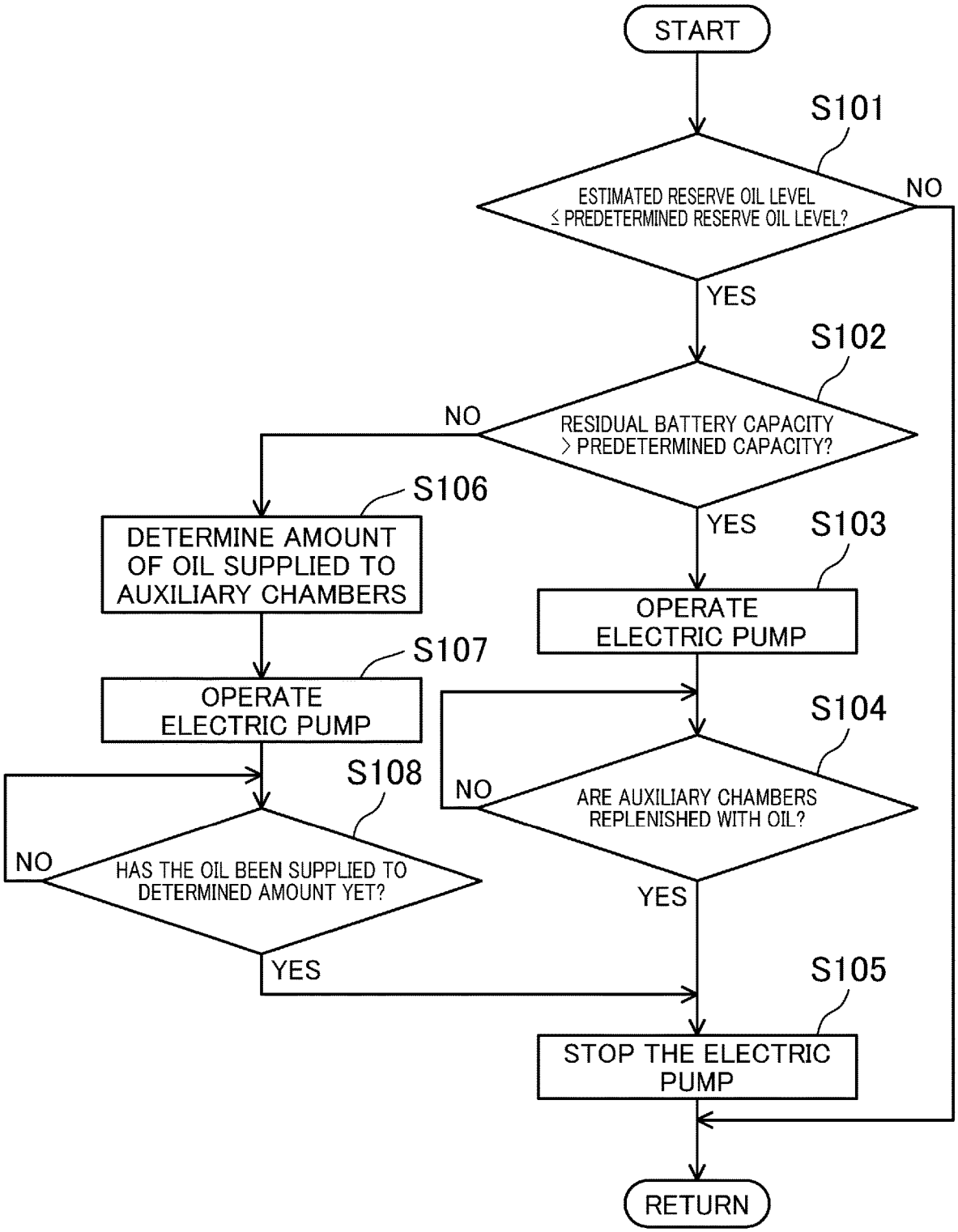
FIG. 6 A flow chart showing the procedure of processing to be performed by a control unit since the engine was turned OFF and until an oil replenishment control is performed.

Next, it will be described with reference to FIG. 6 how the control unit 100 performs processing operation until the oil replenishment control is carried out.

First, in Step S101, the control unit 100 estimates the level of the oil reserved in the auxiliary chambers 42 and determines whether or not the estimated reserve oil level is equal to or less than a predetermined reserve oil level. As described above, the estimated reserve oil level is obtained based on the rate of decline in the level of the oil reserved in the auxiliary chambers 42 which has been obtained based on the configuration of the hydraulically-actuated variable valve opening/closing mechanisms 40 and the estimated oil viscosity. If the answer is YES (i.e., if the estimated reserve oil level is equal to or less than the predetermined reserve oil level), then the process proceeds to Step S102. On the other hand, if the answer is NO (i.e., if the estimated reserve oil level is greater than the predetermined reserve oil level), then the process returns.

In Step S102, the control unit 100 determines whether or not the residual capacity of the battery 30 is greater than a predetermined capacity. This determination is made based on the result of detection obtained by the battery voltage sensor 103. If the answer is YES (i.e., if the residual capacity of the battery 30 is greater than the predetermined capacity), then the process proceeds to Step S103. On the other hand, if the answer is NO (i.e., if the residual capacity of the battery 30 is equal to or less than the predetermined capacity), then the process proceeds to Step S106.

In Step S103, the control unit 100 operates the electric pump 91 with power supplied from the battery 30 to the electric pump 91. In this processing step, the quantity of the power supplied to the electric pump 91 is determined based on the estimated oil viscosity and other factors. After Step S103 is done, the process proceeds to Step S104.

In Step S104, the control unit 100 determines whether or not the auxiliary chambers 42 are replenished with the oil. To make this decision, the control unit 100 determines whether or not the oil pressure in the second oil supply passage 52, detected by the second oil pressure sensor 106, is equal to or greater than a predetermined oil pressure. Specifically, if the oil pressure detected is equal to or greater than the predetermined oil pressure, the decision is made that the auxiliary chambers 42 are replenished with the oil. On the other hand, if the oil pressure detected is less than the predetermined oil pressure, the decision is made that the auxiliary chambers 42 are not replenished with the oil. If the answer is YES (i.e., if the auxiliary chambers 42 are replenished with the oil), the process proceeds to Step S105. On the other hand, if the answer is NO (i.e., if the auxiliary chambers 42 are not replenished with the oil), then the control unit 100 has the oil continuously supplied to the auxiliary chambers 42. After that, the determination is made in Step S104 again.

In Step S105, the control unit 100 stops operating the electric pump 91 with the supply of power from the battery 30 to the electric pump 91 discontinued. After this Step S105 is done, the process returns.

On the other hand, in Step S106, to which the process proceeds if the answer to the question is NO in Step S102, the control unit 100 determines the amount of the oil supplied to the auxiliary chambers 42. This amount of the oil supplied is determined based on the result of detection obtained by the battery voltage sensor 103. Specifically, as described above, the smaller the residual capacity of the battery 30 is, the smaller the amount of the oil supplied is determined to be.

Next, in the Step S107 mentioned above, the control unit 100 operates the electric pump 91 with power supplied from the battery 30 to the electric pump 91. In this processing step, the quantity of the power supplied to the electric pump 91 is determined based on the amount of the oil supplied that has been determined in Step S106, the estimated oil viscosity, and other factors. After Step S107 is done, the process proceeds to Step S108.

In Step S108, the control unit 100 determines whether or not the oil has been supplied to the auxiliary chambers 42 yet to the amount determined in Step S106. This decision whether or not the oil has been supplied to the auxiliary chambers 42 yet to the determined amount is made based on the discharge rate of the electric pump 91, the duration of operation of the electric pump 91, and other factors. If the answer is YES (i.e., if the oil has already been supplied to the auxiliary chambers 42 to the determined amount), the process proceeds to Step S105 to stop operating the electric pump 91. On the other hand, if the answer is NO (i.e., if the oil has not been supplied to the auxiliary chambers 42 yet to the determined amount), then the control unit 100 has the oil continuously supplied to the auxiliary chambers 42. After that, the determination is made in Step S108 again.

The control unit 100 may perform processing based on this flow chart once a day, for example.

Figure 7:
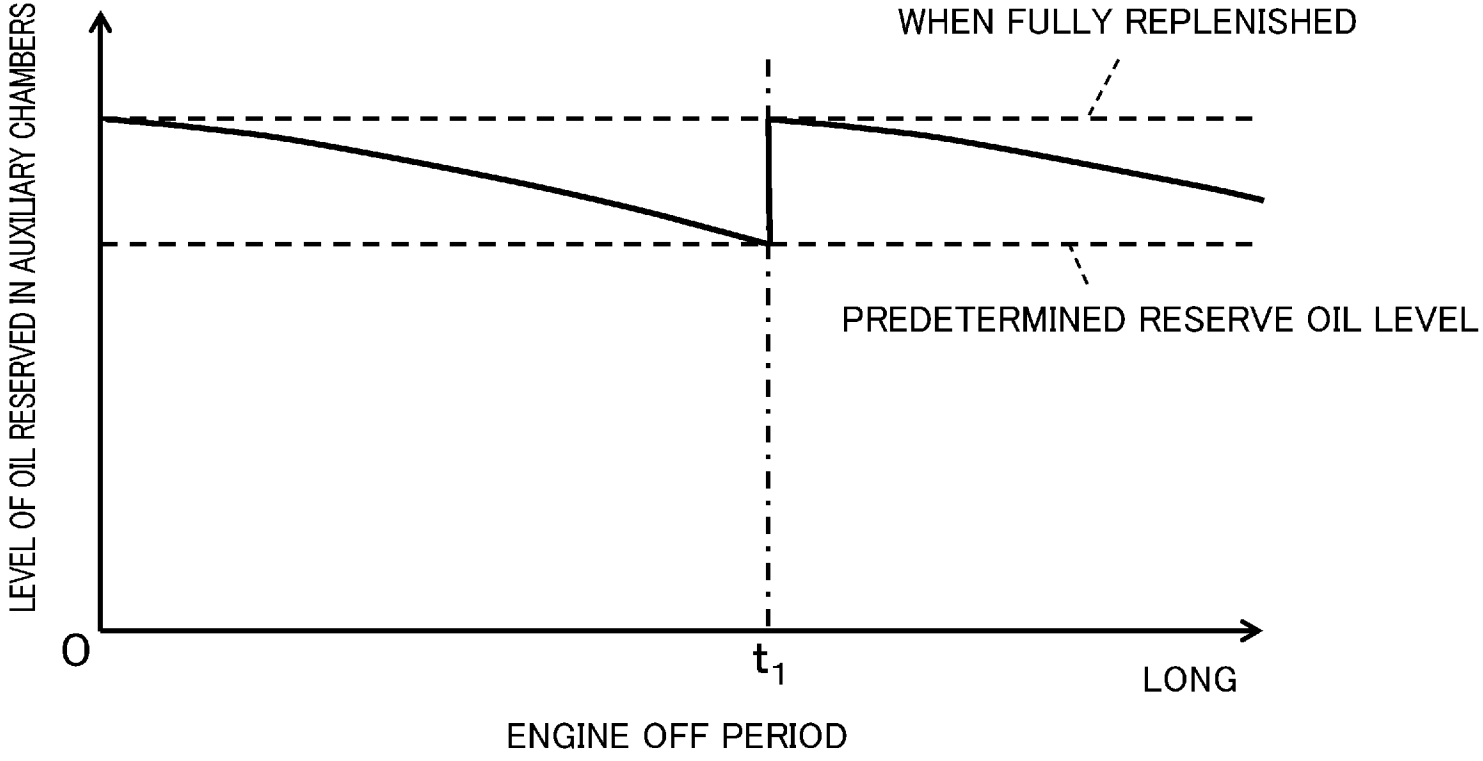
FIG. 7 A graph showing how the level of the oil reserved in an auxiliary chamber changes with the engine OFF period.

FIG. 7 is a graph showing how the level of the oil reserved in the auxiliary chambers 42 changes with the engine OFF period. The ordinate represents the level of the oil reserved in the auxiliary chambers 42 and the abscissa represents the engine OFF period. In FIG. 7, a point in time when the abscissa goes zero indicates the instant when the engine 2 is turned OFF, and the level of the oil reserved in the auxiliary chambers 42 at that instant represents the oil level in the auxiliary chambers 42 in the full state. As for the two broken lines drawn parallel to the axis of abscissas, the one indicating the larger oil level in the auxiliary chambers 42 represents the level of the oil reserved in the auxiliary chambers 42 in the full state, while the other indicating the smaller oil level in the auxiliary chambers 42 represents the predetermined reserve oil level. Furthermore, the one-dot-chain line drawn parallel to the axis of ordinates represents an engine OFF period $t_1$ in which the estimated reserve oil level obtained from the map shown in FIG. 4 becomes equal to or less than the predetermined reserve oil level. Note that FIG. 7 shows a situation where the battery level detected is greater than the predetermined capacity, i.e., a situation where the oil replenishment control is performed such that the oil is supplied continuously until the auxiliary chambers 42 are replenished with the oil.

When the engine 2 is turned OFF, the electric pump 91 is stopped, and the oil is no longer supplied to the auxiliary chambers 42. In the meantime, since the oil leaks from the hydraulically-actuated variable valve opening/closing mechanisms 40, the level of the oil reserved in the auxiliary chambers 42 decreases as the engine OFF period passes. In accordance with the flow chart described above, the control unit 100 estimates the level of the oil reserved in the auxiliary chambers 42 by reference to the map shown in FIG. 4, for example, and does not perform the oil replenishment control described above if the estimated reserve oil level is greater than the predetermined reserve oil level.

Then, when the engine OFF period reaches $t_1$, the level of the oil reserved in the auxiliary chambers 42 becomes generally equal to or less than the predetermined reserve oil level. Since the estimated reserve oil level becomes equal to or less than the predetermined reserve oil level at this time, the control unit 100 performs the oil replenishment control in accordance with the flow chart described above, thereby operating the electric pump 91 to have the oil supplied to the auxiliary chambers 42 continuously until the auxiliary chambers 42 are replenished with the oil.

Even after the auxiliary chambers 42 are replenished with the oil, the oil continues to leak from the hydraulically-actuated variable valve opening/closing mechanisms 40. Thus, the level of the oil reserved in the auxiliary chambers 42 decreases as the period passes by.

After having performed the oil replenishment control, the control unit 100 estimates, based on the amount of time that has actually passed since a reference point in time when the oil replenishment control is finished (i.e., $t_1$ shown in FIG. 7), the level of the oil reserved in the auxiliary chambers 42. Then, when the estimated reserve oil level becomes equal to or less than the predetermined reserve oil level, the control unit 100 performs the oil replenishment control all over again to replenish the auxiliary chambers 42 with the oil.

Thus, this embodiment includes a control unit 100 functioning as a reserve oil level estimator for estimating the level of the oil reserved in the auxiliary chambers 42. This control unit 100 is configured to perform, when estimating the level of the oil reserved in the auxiliary chambers 42 to be equal to or less than a predetermined reserve oil level while the engine 2 is OFF, an oil replenishment control to replenish the auxiliary chambers 42 with the oil by activating the electric pump 91. Thus, even while the engine is OFF, an amount of oil that is large enough to actuate the hydraulically-actuated variable valve opening/closing mechanisms 40 will still be reserved in the auxiliary chambers 42. This reduces a decline in the response of the engine even when the engine is kept OFF for a long time.

The present invention is not limited to the embodiment described above but may be modified or replaced without departing from the true spirit and scope of the appended claims.

For example, in the embodiment described above, the level of the oil reserved in the auxiliary chamber 42 is estimated based on the engine OFF period and the estimated oil viscosity. However, this is only a non-limiting exemplary embodiment. Alternatively, a reserve oil level sensor functioning as a reserve oil level detector for detecting the level of the oil reserved in the auxiliary chambers 42 may be provided instead, and a determination may be made, based on the result of detection obtained by the reserve oil level sensor, whether or not the level of the oil reserved in the auxiliary chambers 42 is equal to or less than the predetermined reserve oil level. In this case, when the reserve oil level sensor detects that the level of the oil reserved in the auxiliary chambers 42 has become equal to or less than the predetermined reserve oil level, the control unit 100 performs the oil replenishment control described above.

Also, the embodiment described above uses, as hydraulically-actuated variable valve mechanisms, the hydraulically-actuated variable valve opening/closing mechanisms 40 along with the intake valve 13 and the exhaust valve 14. However, this is only an example. Alternatively, direct-acting valve opening/closing mechanisms, including a known oil pressure rush adjustor and a hydraulically-actuated valve timing mechanism, may also be used. Still alternatively, the hydraulically-actuated variable valve opening/closing mechanism 40 and a direct-acting valve opening/closing mechanism may also be used in combination. Even in such an alternative embodiment, as long as auxiliary chambers are provided to supply the oil to an oil pressure rush adjuster or a hydraulically-actuated valve timing mechanism, the oil replenishment control also needs to be performed as in the embodiment described above.

Furthermore, in the embodiment described above, the auxiliary chambers 42 are each connected to the downstream end of an associated one of the intake-side and exhaust-side communicating oil passages 55, 56. Alternatively, each of the auxiliary chambers 42 may also be provided halfway along the intake-side or exhaust-side communicating oil passage 55, 56.

Furthermore, in the embodiment described above, the second oil pressure sensor 106 is provided for the second oil supply passage 52. Alternatively, the second oil pressure sensor 106 may be provided for the intake-side and exhaust-side communicating oil passages 55, 56 or for the auxiliary chamber oil passage 41*a*.

Moreover, in the embodiment described above, the level of the oil reserved in the auxiliary chambers 42 is estimated based on the amount of time that has actually passed since the engine 2 was turned OFF, and the oil replenishment control is performed when the estimated reserve oil level becomes equal to or less than the predetermined reserve oil level. Alternatively, instead of the estimated reserve oil level itself, a period of time it takes for the estimated reserve oil level to become equal to or less than the predetermined reserve oil level may be obtained by reference to the map shown in FIG. 4, for example, and the oil replenishment control may start to be performed when that period of time passes.

Furthermore, the embodiment described above uses, as an oil pump for supplying the oil to the lubricating part 60 of the engine 2, a variable-displacement mechanical oil pump. Alternatively, an electric oil pump may be used instead. Still alternatively, the variable-displacement oil pump may be replaced with an ordinary oil pump, of which the oil discharge rate is variable only with the engine speed.

Note that each and every embodiment described above is just an example in any respect and should not be construed to be a limiting one. The scope of the present invention is defined only by the appended claims, and any variations or modifications falling within the range of equivalents to the claims are all encompassed within the scope of the present invention.

INDUSTRIAL APPLICABILITY

The present invention is useful for an engine oil supply device including a hydraulically-actuated variable valve mechanism for hydraulically controlling opening and closing of an intake valve or an exhaust valve and an oil reservoir for supplying the oil to the hydraulically-actuated variable valve mechanism while the internal combustion engine is OFF.

DESCRIPTION OF REFERENCE CHARACTERS

1 Oil Supply Device
2 Engine (Internal Combustion Engine)

13 Intake Valve
14 Exhaust Valve
30 Battery (Storage Battery)
40 Hydraulically-Actuated Variable Valve Opening/Closing Mechanism (Hydraulically-Actuated Variable Valve Mechanism)
41*a* Auxiliary Chamber Oil Passage (Variable Valve Mechanism Oil Supply Passage)
42 Auxiliary Chamber (Oil Reservoir)
43 Valve Oil Pressure Control Valve (Oil Pressure Control Valve)
44 Cam
45 First Transmission Chamber
46 Second Transmission Chamber
51 First Oil Supply Passage (Lubricating Part Oil Supply Passage)
52 Second Oil Supply Passage (Variable Valve Mechanism Oil Supply Passage)
53 Auxiliary Oil Supply Passage
55 Intake-Side Communicating Oil Passage (Variable Valve Mechanism Oil Supply Passage)
56 Exhaust-Side Communicating Oil Passage (Variable Valve Mechanism Oil Supply Passage)
86 Check Valve
91 Electric Oil Pump
100 Control Unit (Controller, Reserve Oil Level Estimator, Oil Viscosity Estimator)
103 Battery Voltage Sensor (Residual Battery Level Detector)
105 First Oil Pressure Sensor (Lubricating Part Oil Pressure Detector)
106 Second Oil Pressure Sensor (Variable Valve Mechanism Oil Pressure Detector)

The invention claimed is:

1. An oil supply device for an internal combustion engine, the device comprising:

a hydraulically-actuated variable valve mechanism provided for the internal combustion engine and configured to open and close a valve by hydraulically transmitting a power of a cam, rotating in accordance with an output of the internal combustion engine, to the valve;

an electric oil pump operating with power supplied from a storage battery and configured to supply oil to the hydraulically-actuated variable valve mechanism;

a variable valve mechanism oil supply passage configured to supply the oil discharged from the electric oil pump to the hydraulically-actuated variable valve mechanism;

an oil reservoir arranged halfway along the variable valve mechanism oil supply passage and upstream of the cam, the oil reservoir being configured to reserve the oil discharged from the electric oil pump and to supply the reserved oil to the hydraulically-actuated variable valve mechanism while the internal combustion engine is OFF;

a controller configured to control activation of the electric oil pump; and a reserve oil level estimator configured to estimate the level of the oil reserved in the oil reservoir; or a reserve oil level detector configured to detect the level of the oil reserved in the oil reservoir, wherein when the reserve oil level estimator estimates, or the reserve oil level detector detects, that the level of the oil reserved in the oil reservoir has become equal to or less than a predetermined reserve oil level while the internal combustion engine is OFF, the controller performs an oil replenishment control to replenish the oil reservoir with the oil by activating the electric oil pump.

2. The oil supply device of claim 1, further comprising an oil viscosity estimator configured to estimate a viscosity of the oil discharged from the electric oil pump, wherein the electric oil pump is able to change a discharge pressure of the oil according to the magnitude of the power supplied from the storage battery, and when performing the oil replenishment control, the controller determines the magnitude of the power supplied to the electric oil pump based on the oil viscosity estimated by the oil viscosity estimator while the internal combustion engine is still running but on the verge of being turned OFF, and operates the electric oil pump with the determined magnitude of power.

3. The oil supply device of claim 1, wherein the oil supply device includes the reserve oil level estimator configured to estimate the level of the oil reserved in the oil reservoir based on the amount of time that has actually passed since the internal combustion engine was turned OFF, and the controller performs the oil replenishment control when the level of the oil reserved in the oil reservoir, estimated by the reserve oil level estimator, becomes equal to or less than the predetermined reserve oil level.

4. The oil supply device of claim 1, wherein when performing the oil replenishment control, the controller has the oil supplied continuously until the oil reservoir is replenished with the oil and then stops operating the electric oil pump.

5. The oil supply device of claim 4, further comprising a variable valve mechanism oil pressure detector configured to detect an oil pressure in the variable valve mechanism oil supply passage, wherein when the oil pressure detected by the variable valve mechanism oil pressure detector becomes equal to or greater than a predetermined oil pressure, the controller determines that the oil reservoir is replenished with the oil.

6. The oil supply device of claim 1, further comprising a mechanical oil pump operating with power generated by the internal combustion engine and configured to supply the oil to a lubricating part of the internal combustion engine, wherein the electric oil pump supplies the oil only to the hydraulically-actuated variable valve mechanism without supplying the oil to the lubricating part.

7. The oil supply device of claim 6, further comprising a variable valve mechanism oil pressure detector configured to detect an oil pressure in the variable valve mechanism oil supply passage;

a lubricating part oil supply passage configured to supply the oil discharged from the mechanical oil pump to the lubricating part;

a lubricating part oil pressure detector configured to detect an oil pressure in the lubricating part oil supply passage;

an auxiliary oil supply passage configured to connect the variable valve mechanism oil supply passage and the lubricating part oil supply passage together; and a check valve provided for the auxiliary oil supply passage and configured to allow the oil to flow from the lubricating part oil supply passage into the variable valve mechanism oil supply passage and prevent the oil from flowing from the variable valve mechanism oil supply passage into the lubricating part oil supply passage, wherein the valve includes an intake valve provided for an intake-side part of the internal combustion engine and an exhaust valve provided for an exhaust-side part of the internal combustion engine, the hydraulically-actuated variable valve mechanism is provided for each of the intake-side and exhaust-side parts, the variable valve mechanism oil supply passage includes an intake-side communicating oil passage for supplying the oil to the intake-side hydraulically-actuated variable valve mechanism, and an exhaust-side communicating oil passage for supplying the oil to the exhaust-side hydraulically-actuated variable valve mechanism, the lubricating part oil pressure detector is arranged downstream of the check valve on the lubricating part oil supply passage, and the variable valve mechanism oil pressure detector is arranged downstream of the check valve and upstream of the intake-side communicating oil passage and the exhaust-side communicating oil passage on the variable valve mechanism oil supply passage.

8. The oil supply device of claim 1, wherein the hydraulically-actuated variable valve mechanism includes: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the magnitude of the oil pressure transmitted from the first transmission chamber to the second transmission chamber and a timing of transmitting the oil pressure from the first transmission chamber to the second transmission chamber, the variable valve mechanism adjusting, using the oil pressure control valve, the degree and timing of opening and closing the valve.

9. The oil supply device of claim 8, wherein the oil pressure control valve is connected to the oil reservoir, the first transmission chamber, and the second transmission chamber and is able to shift between an opened state in which the oil pressure control valve allows the oil reservoir and the second transmission chamber to communicate with each other and a closed state in which the oil pressure control valve cuts off communication between the oil reservoir and the second transmission chamber, and the hydraulically-actuated variable valve mechanism transmits the oil pressure from the first transmission chamber to the second transmission chamber when the oil pressure control valve is in the closed state and does not transmit the oil pressure from the first transmission chamber to the second transmission chamber when the oil pressure control valve is in the opened state.

10. The oil supply device of claim 2, wherein the oil supply device includes the reserve oil level estimator configured to estimate the level of the oil reserved in the oil reservoir based on the amount of time that has actually passed since the internal combustion engine was turned OFF, and the controller performs the oil replenishment control when the level of the oil reserved in the oil reservoir, estimated by the reserve oil level estimator, becomes equal to or less than the predetermined reserve oil level.

11. The oil supply device of claim 2, wherein when performing the oil replenishment control, the controller has the oil supplied continuously until the oil reservoir is replenished with the oil and then stops operating the electric oil pump.

12. The oil supply device of claim 3, wherein when performing the oil replenishment control, the controller has the oil supplied continuously until the oil reservoir is replenished with the oil and then stops operating the electric oil pump.

13. The oil supply device of claim 2, further comprising a mechanical oil pump operating with power generated by the internal combustion engine and configured to supply the oil to a lubricating part of the internal combustion engine, wherein the electric oil pump supplies the oil only to the hydraulically-actuated variable valve mechanism without supplying the oil to the lubricating part.

14. The oil supply device of claim 3, further comprising a mechanical oil pump operating with power generated by the internal combustion engine and configured to supply the oil to a lubricating part of the internal combustion engine, wherein the electric oil pump supplies the oil only to the hydraulically-actuated variable valve mechanism without supplying the oil to the lubricating part.

15. The oil supply device of claim 4, further comprising a mechanical oil pump operating with power generated by the internal combustion engine and configured to supply the oil to a lubricating part of the internal combustion engine, wherein the electric oil pump supplies the oil only to the hydraulically-actuated variable valve mechanism without supplying the oil to the lubricating part.

16. The oil supply device of claim 2, wherein the hydraulically-actuated variable valve mechanism includes: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the magnitude of the oil pressure transmitted from the first transmission chamber to the second transmission chamber and a timing of transmitting the oil pressure from the first transmission chamber to the second transmission chamber, the variable valve mechanism adjusting, using the oil pressure control valve, the degree and timing of opening and closing the valve.

17. The oil supply device of claim 3, wherein the hydraulically-actuated variable valve mechanism includes: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the magnitude of the oil pressure transmitted from the first transmission chamber to the second transmission chamber and a timing of transmitting the oil pressure from the first transmission chamber to the second transmission chamber, the variable valve mechanism adjusting, using the oil pressure control valve, the degree and timing of opening and closing the valve.

18. The oil supply device of claim 4, wherein the hydraulically-actuated variable valve mechanism includes: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the magnitude of the oil pressure transmitted from the first transmission chamber to the second transmission chamber and a timing of transmitting the oil pressure from the first transmission chamber to the second transmission chamber, the variable valve mechanism adjusting, using the oil pressure control valve, the degree and timing of opening and closing the valve.

19. The oil supply device of claim 6, wherein the hydraulically-actuated variable valve mechanism includes: a first transmission chamber configured to make the cam's power act on the oil and convert the cam's power into an oil pressure; a second transmission chamber configured to transmit the oil pressure converted by the first transmission chamber to the valve; and an oil pressure control valve configured to control the magnitude of the oil pressure transmitted from the first transmission chamber to the second transmission chamber and a timing of transmitting the oil pressure from the first transmission chamber to the second transmission chamber, the variable valve mechanism adjusting, using the oil pressure control valve, the degree and timing of opening and closing the valve.

* * * * *